US007450014B2

(12) United States Patent
Farhadian

(10) Patent No.: US 7,450,014 B2
(45) Date of Patent: Nov. 11, 2008

(54) OPEN FASTENER INDICATOR

(76) Inventor: Houshang Farhadian, 23861 W. McBean Pkwy., #E22, Valencia, CA (US) 91355

( * ) Notice: Subject to any disclaimer, the term of this patent is extended or adjusted under 35 U.S.C. 154(b) by 180 days.

(21) Appl. No.: 11/402,233

(22) Filed: Apr. 10, 2006

(65) Prior Publication Data

US 2007/0236361 A1 Oct. 11, 2007

(51) Int. Cl.
*G08B 21/24* (2006.01)

(52) U.S. Cl. ..... 340/573.1; 340/687; 340/686.1; 340/571; 200/550; 24/381

(58) Field of Classification Search ..... 340/573.1, 340/687; 200/550
See application file for complete search history.

(56) References Cited

U.S. PATENT DOCUMENTS 2,949,612 A * 8/1960 Kafko et al. ..... 2/234
4,603,327 A * 7/1986 Leonard et al. ..... 340/573.1
6,714,133 B2 * 3/2004 Hum et al. ..... 340/573.4
6,747,227 B2 * 6/2004 Marmaropoulos et al. .. 200/550
6,801,140 B2 * 10/2004 Mantyjarvi et al. ..... 340/999
7,304,600 B2 * 12/2007 Nehls et al. ..... 341/176
2006/0293151 A1 * 12/2006 Rast ..... 482/8
2007/0107652 A1 * 5/2007 Michida ..... 116/137 R

FOREIGN PATENT DOCUMENTS

EP 0303481 A2 * 11/1988
JP 08038217 * 8/1994

OTHER PUBLICATIONS

JP 08-038217 A, Hayasi Kanako, 1996, (machine translation for JP patent document previously provided).*
JP 08-038217 A, Hayasi Kanako, 1996, (Official translation for JP patent document previously provided).*

* cited by examiner

*Primary Examiner*—Jeff Hofsass
*Assistant Examiner*—Anne V. Lai
(74) *Attorney, Agent, or Firm*—Century IP Group, Inc.; F. Jason Far-hadian, Esq.

(57) ABSTRACT

In accordance with one embodiment, an apparatus is provided for generating an alert signal when a fastener for closing and opening a clothing item is open. The apparatus comprises a first unit for detecting that the fastener is open; a second unit for detecting that the clothing item is worn; and an alert mechanism for generating an alert signal when the first unit detects that the fastener is open and the second unit detects that the clothing item is worn.

12 Claims, 3 Drawing Sheets

OPEN FASTENER INDICATOR

COPYRIGHT & TRADEMARK NOTICE

A portion of the disclosure of this patent document contains material, which is subject to copyright protection. The owner has no objection to the facsimile reproduction by any one of the patent document or the patent disclosure, as it appears in the Patent and Trademark Office patent file or records, but otherwise reserves all copyrights whatsoever.

Certain marks referenced herein may be common law or registered trademarks of third parties affiliated or unaffiliated with the applicant or the assignee. Use of these marks is by way of example and shall not be construed as descriptive or to limit the scope of this invention to material associated only with such marks.

FIELD OF THE INVENTION

The present invention relates in general to fasteners for openings or portions of articles of clothing, and more particularly to an indicator in operational relationship with a fastener for detecting and reporting the status of the fastener.

BACKGROUND

Zippers and other types of fasteners are used to allow certain portions of clothing to be adjusted or fitted so that a person can easily wear a clothing item, such as a pair of trousers. Typically, a person first unfastens the zipper in order to enlarge an opening that allows the user to put on the clothing item. The person then fastens or zips the zipper to close or tighten the respective opening to cover any exposed body parts or to secure the clothing more firmly around the wearer.

Unfortunately, sometimes a person forgets to fasten the zipper or the zipper is unfastened unintentionally. Thus, it is not uncommon for people to walk around with open zippers or unbuttoned blouses because they forgot to fasten them or the fastener has come undone. To avoid such embarrassing situations, there is a need for a system to alert the wearer about the open status of the fastener.

SUMMARY OF THE INVENTION

To minimize the problems in the prior art, and to minimize other limitations that will become apparent upon reading the present disclosure, the present invention is directed to a device for notifying the wearer of a clothing item of an open status of a fastener. In accordance to one embodiment, an apparatus for generating an alert signal when a fastener for closing an opening in a clothing item is open.

Features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

In accordance with one aspect of the invention, an apparatus for generating an alert signal when a fastener for closing an opening in a clothing item is open is provided. The apparatus comprises a first unit for detecting that the fastener is open; a second unit for detecting that the clothing item is worn; and an alert mechanism for generating an alert signal when the first unit detects that the fastener is open and the second unit detects that the clothing item is worn.

The first unit comprises electrical couplings connecting the fastener to an electrical circuit comprising the alert mechanism, so that the alert mechanism is deactivated when the first unit detects that the fastener is closed. The fastener comprises first and second contacts, wherein the first unit detects that the fastener is open if the first contact is not coupled to the second contact. The fastener may comprise a zipper having first and second opposing top stops, such that when the first and second opposing top stops are not electrically connected the first unit detects that the fastener is open.

In some embodiments, the second unit comprises electrical couplings connecting a button and buttonhole combination to an electrical circuit, wherein when the button is engaged in the buttonhole, the second unit detects that the clothing item is worn. In one embodiment, the second unit comprises electrical couplings connecting a hook and a hook hole to an electrical circuit, wherein when the hook is engaged in the hook hole, the second unit detects that the clothing item is worn.

The second unit may also comprise a heat sensor for detecting that the clothing item is worn when the sensor detects a certain level of body heat. The second unit may also comprise a pressure sensor for detecting that the clothing item is worn when a certain level of pressure is applied to the sensor. The second unit may be installed at waist area of the clothing item.

In one embodiment, the fastener comprises a zipper having first and second opposing teeth such that when the first and second opposing teeth are not electrically connected the first unit detects that the fastener is open. The alert signal may be audible or tactile, for example. In a preferred embodiment, the alert signal is generated after a threshold time has passed, in response to the first unit detecting that the fastener is open and the second unit detecting that the clothing item is worn. In certain embodiments, the alert signal is generated intermittently.

These and other embodiments of the present invention will also become readily apparent to those skilled in the art from the following detailed description of the embodiments having reference to the attached figures, the invention not being limited to any particular embodiments disclosed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. It is to be understood that other embodiments may be utilized and structural changes may be made without departing from the scope of the present invention.

Features, elements, and aspects of the invention that are referenced by the same numerals in different figures represent the same, equivalent, or similar features, elements, or aspects in accordance with one or more embodiments of the system.

DETAILED DESCRIPTION OF THE PREFERRED EMBODIMENTS

Figure 1:
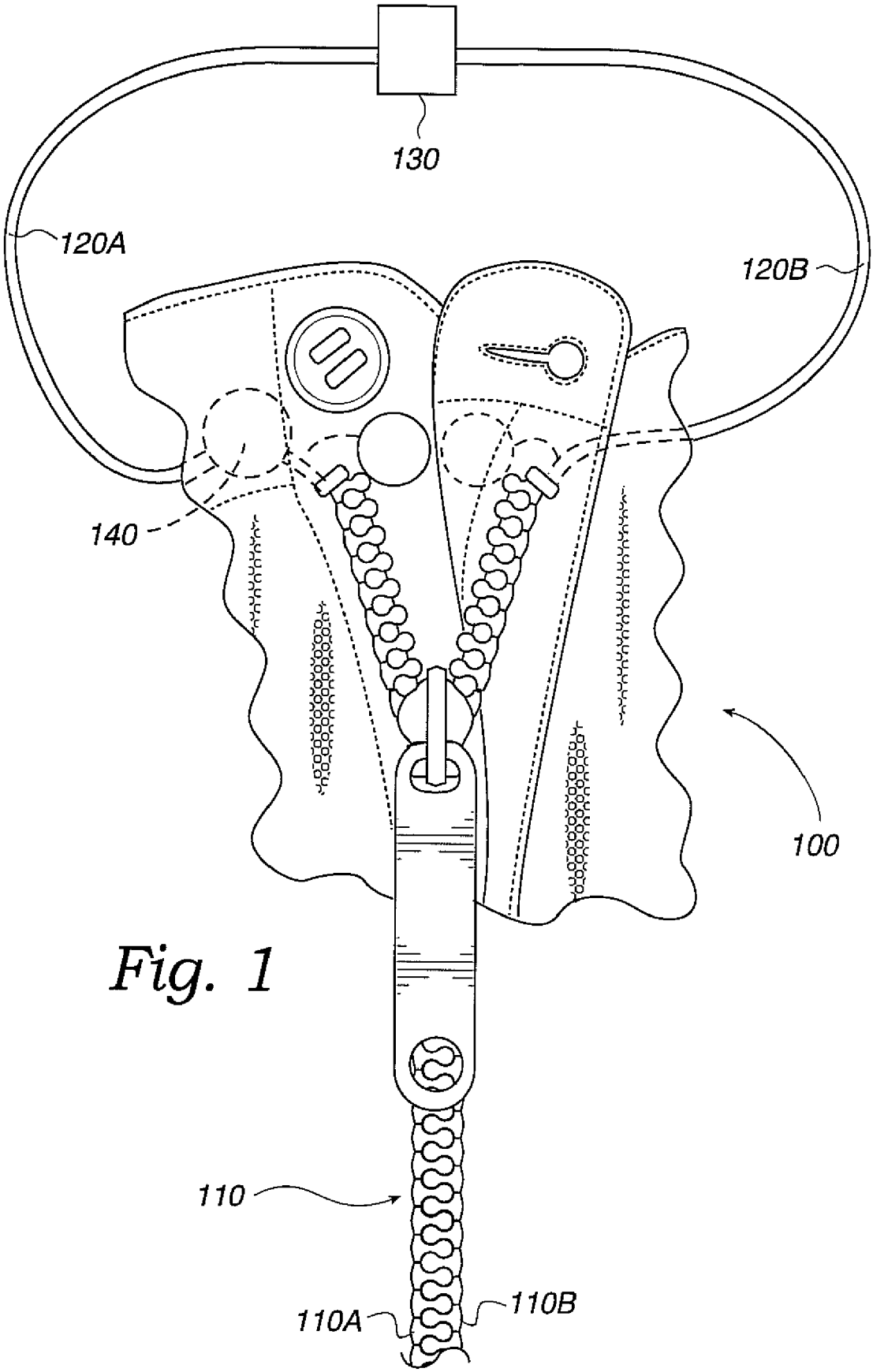
FIG. 1 illustrates an exemplary alarm system according to one embodiment of the invention using a zipper with a circuit and alarm connected to the teeth of the zipper.

Referring to FIG. 1, a fastening device alarm system of the present invention is illustrated, using a zipper with a circuit and alarm connected onto a first and second top stops of the zipper. While, in accordance with one embodiment, the present invention is defined with respect to a zipper mechanism by way of example, the principals, concepts and elements disclosed here are applicable to other fastening means and mechanisms (e.g., buckles, belts, buttons, strings, etc.) and their functional and structural equivalents.

Fastening mechanism 100 as shown in FIG. 1 comprises a zipper 110 having first and second top stops 110A and 110B, conductive connections 120A and 120B, circuit 130, and alarm 140. In accordance with a preferred embodiment, fastening mechanism 100 can have a monolithic structure or can be manufactured from multi-assembly components.

Zipper 110 comprises one or more teeth and can be made of metallic (e.g., cast iron, steel, etc.) or non-metallic (e.g., plastic) materials. When both halves of a zipper are meshed together, the teeth form a continuous piece called a chain. First and second top stops 110A and 110B are affixed to the top end of a zipper to prevent the zipper's slider from coming off the chain. First and second top stops 110A and 110B can be made of metallic or non-metallic materials.

In one embodiment, two opposing top stops 110A and 110B are in operational relationship with circuit 130 and act as contact points to form a closed circuit including alarm 140. In some embodiments, the opposing top stops 110A and 110B are made from metallic material to act as conductors of electricity fed to the system from a power source (not shown). In another embodiment, electrical contacts may be metallically coated or attached to the opposing top stops 110A and 110B, respectively to accomplish the same objective.

The opposing top stops 110A and 110B are preferably be insulated from the teeth of the zipper if the teeth are also made of metallic material to avoid possible electric shock to a wearer. It is noteworthy that, while this invention is disclosed with respect to top stops 110A and 110B being positioned on the upper end of the zipper 110, in alternative embodiments the position of top stops 110A and 110B may be toward the middle of zipper 110, and in certain embodiments the opposing teeth of the zipper may be utilized to perform the same function as top stops 110A and 110B.

In an exemplary embodiment, the top stops 110A and 110B each have electrical connections to the circuit 130 and alarm 140. This connection may be achieved through the use of conductive wires 120A and 120B, for example, or can be wireless. An embodiment of the invention thus may use wireless technologies such as Bluetooth, Infrared, RFID, etc. to provide means of communication between the different system components.

In one embodiment, one of the opposing top stops 110A or 110B may be connected electrically to the cathode of the circuit 130, which in turn is connected to the alarm 140. The other top stop may be connected to the anode of the circuit 130 or vice versa. When the opposing top stops 110A and 110B are in contact (e.g., when the zipper is closed), a first signal is sent to the circuit 130. When opposing top stops 110A and 110B are not in contact (e.g., when the zipper is open), the circuit 130 does not receive the first signal.

In yet another embodiment, alarm 140 may be triggered by installing detecting mechanisms such as pressure sensors around a first area (e.g., the belt or waist area) of the article of clothing, such that the pressure around this first area can be monitored to determine if the article of clothing is worn. In this embodiment, alarm 140 is triggered if the detected pressure indicates that the article is worn and when it is detected that the opposing top stops 110A and 110B are not in contact.

Circuit 130 may comprise a microchip or other electronic mechanism that functions to determine if the alarm 140 should be triggered. Circuit 130 may also control the timing and the sound or other sensory alert for the alarm 140 when the alarm is triggered. In one embodiment, alarm 140 is triggered when the circuit 130 does not receive the first signal. Thus, when opposing top stops 110A and 110B are not in contact, alarm 140 is turned on after a predetermined time.

In an alternative embodiment, multiple sets of opposing teeth in the zipper may be connected to the circuit 130 (instead of or in conjunction with top stops 110A and 110B) so that the alarm 140 is triggered if one or more sets of teeth are not in contact after a threshold time period has passed. Accordingly, in this embodiment, a halfway closed zipper may trigger the alarm 140 when a predetermined set of opposing teeth remain open. The extent to which the zipper 110 can be left open before alarm 140 is triggered may be adjusted in accordance with one or more embodiments.

It should be noted that the above embodiments may be implemented independent from a timer mechanism. Also, the above examples for triggering alarm 140 are provided as preferred embodiments. However, other methods for triggering alarm 140 can be used without detracting from the scope of the present invention. In certain embodiments, fastening mechanism 100 or its individual components, such as the alarm 140, can be removed for washing or are made of waterproof material. In certain embodiments, the components may be enclosed in a hidden compartment of the clothing, and substantially small in size not to be noticed, seen or felt when worn.

Figure 2:
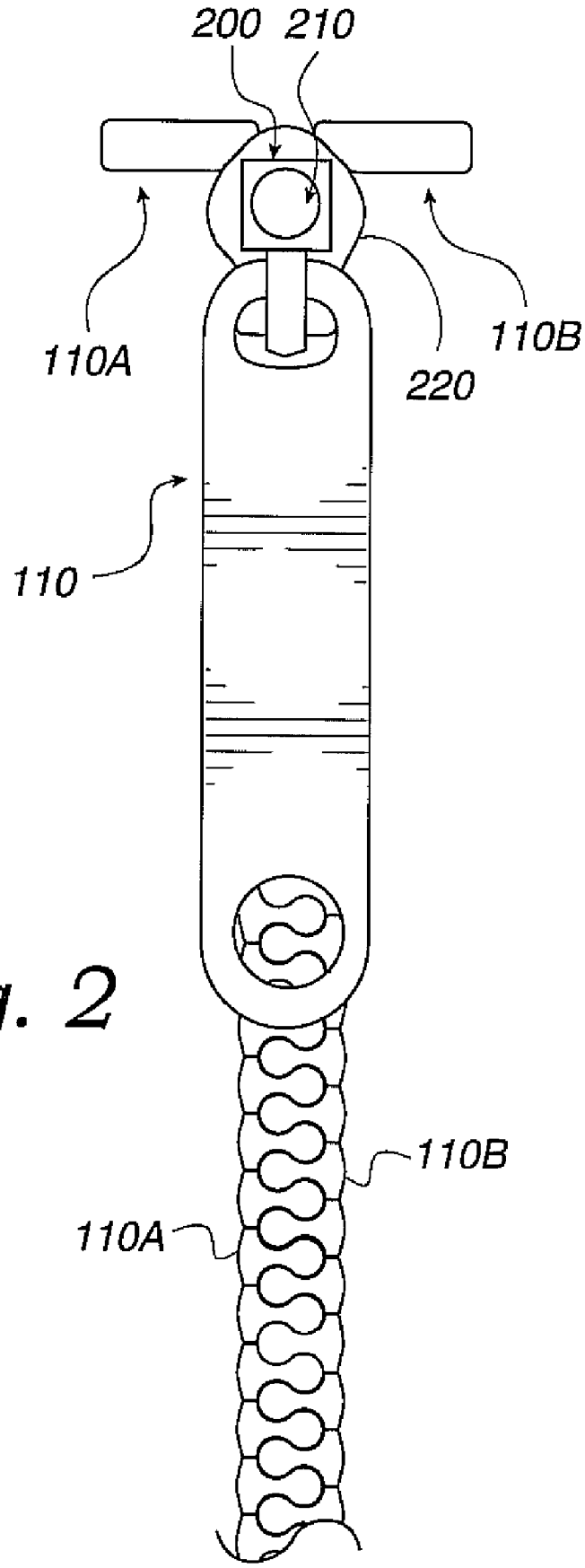
FIG. 2 illustrates an exemplary alarm system according to another embodiment of the invention using a zipper with a circuit and alarm connected to a slider of the zipper.

Referring to FIG. 2, an embodiment of the invention is illustrated having a zipper 110 for the clothing enclosure where the circuit 200 and alarm 210, may be mounted directly onto a slider 220 of the zipper 110. The circuit 200 is completed when opposing top stops 110A and 110B are engaged.

In an exemplary embodiment, the slider 220 is made of conductive material and designed to create the connections necessary between the opposing top stops 110A and 110B, the alarm 210 and the rest of the circuit 200. One top stop 110A/110B can create a connection to an anode mounted on the underside of the slider 220 and the other opposing tooth 110A/110B can create a connection to a cathode mounted on the underside of the slider 220.

Figure 3:
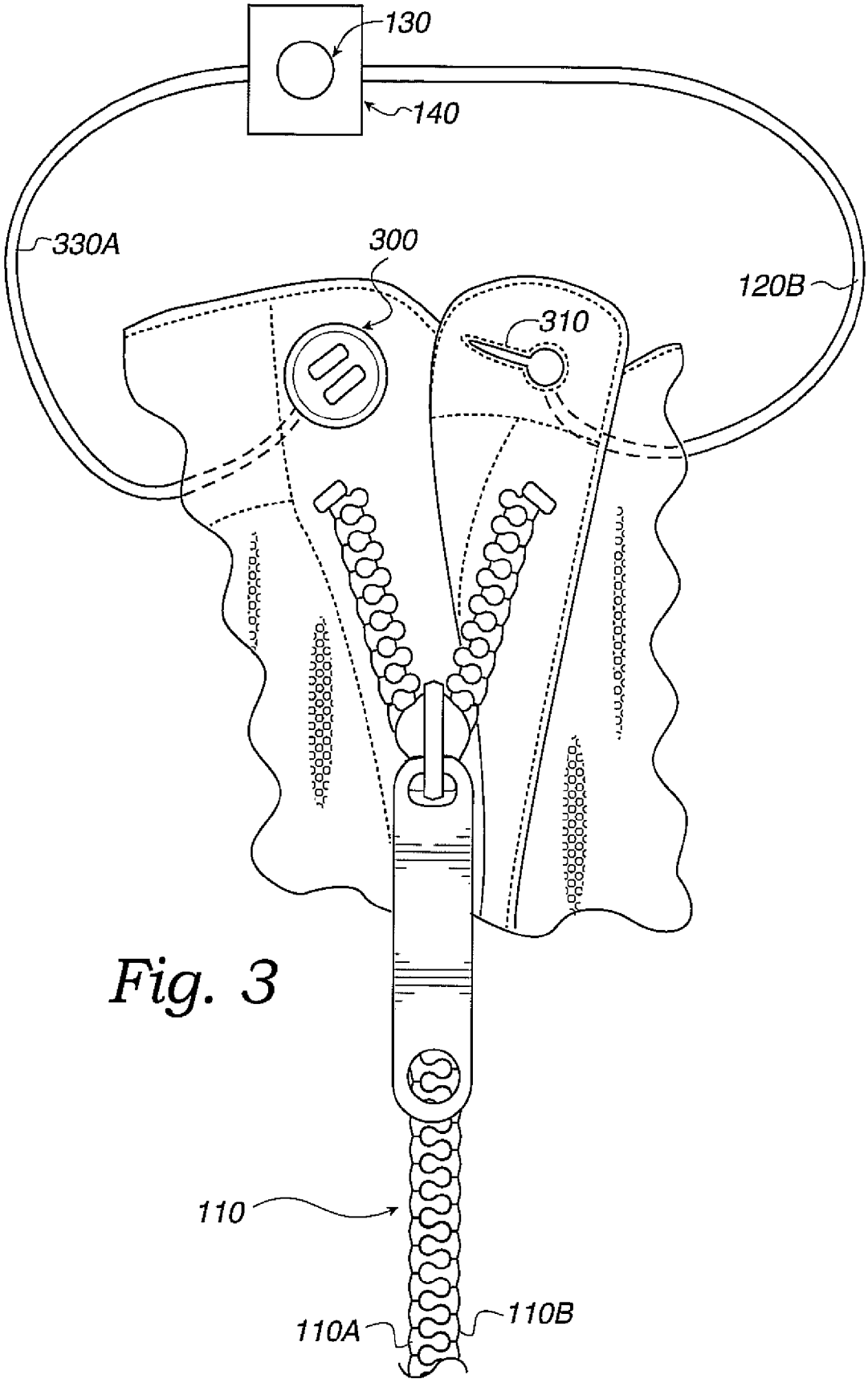
FIG. 3 illustrates another exemplary alarm system in accordance with yet another embodiment of the invention using a button and buttonhole combination as the fastener.

FIG. 3 illustrates another possible embodiment of alarm system 100 with a button 300, buttonhole 310, conductive wires 330A and 330B, circuit 130, and alarm 140. The combination of button 300 and buttonhole 310 can be used to fasten the clothing. The button 300 is made either of a conductive material or at least partially plated by a conductive material.

The corresponding buttonhole 310 is also preferably outlined by a conductive material. The button 300 may be electrically connected to the rest of the circuit 130 through conductive wires 330A. The buttonhole 310 can be connected through conductive wire 330B to circuit 130, or can be wireless. An embodiment of the invention thus may use wireless technologies such as Bluetooth, Infrared, RFID, etc. to provide means of communication between the different system components.

In an embodiment of the invention, when the button 300 is inserted in the buttonhole 310, an electrical circuit is closed due to the button 300 contacting the conductive outline of the buttonhole 310. Multiple sets of button and buttonhole combinations may be connected to the circuit simultaneously without departing from the present invention in one or more embodiments.

In other embodiments, the button/buttonhole combination may be used to detect whether the article of clothing is worn. For example, a detecting unit may determine that the clothing item is worn if button 300 is engaged to buttonhole 310. A detecting mechanism may be also included to determine if the zipper 110 is in an open or closed position. This can be achieved by determining if one or more teeth of the zipper 110 are engaged, as provided in detail above.

The alarm system may be set up so that when one or multiple pairs of button and buttonhole combinations are open longer than a predetermined time after the article of clothing is worn, the alarm triggers. Alarm system 100 can be removed for washing. However, instead of making alarm system 100 removable, alarm system 100 or one or more of its components can be permanently attached to the article of clothing and enclosed in a waterproof compartment or designed so that one or more component can be exposed to water and other wash elements without getting damaged or rendered unusable.

Accordingly, if the detecting mechanism detects that the zipper 110 is open while the clothing item is worn, then an alert signal is generated. The signal can be any signal for notifying the wearer that the fastener 100 is open. Any sensory or tactile output such as sound, light or vibration, for example, may be used to alert the wearer. Depending on implementation, the current system may be applied to other fastening mechanisms such as buttons, hooks, clasps, snap-fit fasteners, Velcro™, elastic bands, or other functional or structural equivalents.

The foregoing description of the preferred embodiment of the invention has been presented for purposes of illustration and description. It is not intended to be exhaustive or to limit the invention to the precise forms disclosed. Many modifications and variations are possible in light of the above teaching. Thus, it should be understood that the invention is not limited by the foregoing descriptions of the preferred embodiments, but embraces all alternatives, modifications and variations in accordance with the spirit and scope of the appended claims and their full scope of equivalents.

What is claimed is:

1. An apparatus for generating an alert signal when a fastener for closing an opening in a clothing item is open, the apparatus comprising:

a first unit for detecting that the fastener is open;

a second unit comprising:

a micro-controller, a button and buttonhole combination, and a heat sensor, wherein the button and buttonhole combination and the heat sensor communicate with the microcontroller to provide signals indicating engagement of the button to the buttonhole and the level of heat detected when the clothing item is worn, wherein when the microcontroller detects that the button is engaged in the buttonhole and the level of heat detected by the heat sensor is beyond a first threshold, then the second unit detects that the clothing item is worn; and an alert mechanism for generating an alert signal when the first unit detects that the fastener is open and the second unit detects that the clothing item is worn.

2. The apparatus of claim 1, wherein the first unit comprises electrical couplings connecting the fastener to an electrical circuit comprising the alert mechanism, so that the alert mechanism is deactivated when the first unit detects that the fastener is closed.

3. The apparatus of claim 1, wherein the fastener comprises first and second contacts, wherein the first unit detects that the fastener is open if the first contact is not coupled to the second contact.

4. The apparatus of claim 1, wherein the fastener comprises a zipper having first and second opposing top stops such that when the first and second opposing top stops are not electrically connected the first unit detects that the fastener is open.

5. The apparatus of claim 1, wherein the fastener is a button.

6. The apparatus of claim 1, wherein the second unit comprises electrical couplings connecting a hook and a hook hole to an electrical circuit, wherein when the hook is engaged in the hook hole, the second unit detects that the clothing item is worn.

7. The apparatus of claim 1, wherein the heat sensor wirelessly communicates with the microcontroller.

8. The apparatus of claim 1, wherein the fastener comprises a zipper having first and second opposing teeth such that when the first and second opposing teeth are not electrically connected the first unit detects that the fastener is open.

9. The apparatus of claim 1, wherein the alert signal is audible.

10. The apparatus of claim 1, wherein the alert signal is tactile.

11. The apparatus of claim 1, wherein the alert signal is generated after a threshold time has passed, in response to the first unit detecting that the fastener is open and the second unit detecting that the clothing item is worn.

12. The apparatus of claim 1, wherein the alert signal is generated intermittently.

* * * * *